United States Patent [19]

Combs

[11] Patent Number: 5,054,180

[45] Date of Patent: Oct. 8, 1991

[54] HINGE PIN TOOL

[76] Inventor: Paul D. Combs, 1268 Oakfield Dr., North, Columbus, Ohio 43229

[21] Appl. No.: 496,816

[22] Filed: Mar. 21, 1990

[51] Int. Cl.[5] ..... B25B 27/14

[52] U.S. Cl. ..... 29/275; 254/21

[58] Field of Search ..... 29/275, 270, 278; 254/28, 21, 25; 81/463

[56] References Cited

U.S. PATENT DOCUMENTS

| | | | |
|---|---|---|---|
| 2,176,626 | 10/1939 | Gentry | 29/275 |
| 2,275,732 | 3/1942 | Chubb | 29/275 |
| 3,602,969 | 9/1971 | Provost | 29/275 |
| 4,188,701 | 2/1980 | Ludwig | 29/275 |
| 4,432,125 | 2/1984 | Monteleone | 29/275 |
| 4,627,141 | 12/1986 | Teske | 29/275 |

FOREIGN PATENT DOCUMENTS

| | | | |
|---|---|---|---|
| 2075410 | 11/1981 | United Kingdom | 29/275 |

*Primary Examiner*—J. J. Hartman

*Attorney, Agent, or Firm*—Watkins, Dunbar & Pollick

[57] ABSTRACT

A hinge pin tool having a particular form and constructed to facilitate removing headed hinge pins from the hinges in unibody automobile repairs. The tool is especially configured to receive and apply heavy, forceful blows to the hinge pin with the blows being delivered at a spaced distance from the operator's hand to prevent injury.

3 Claims, 1 Drawing Sheet

HINGE PIN TOOL

FIELD OF THE INVENTION

This invention relates to a tool that is useful to remove the door hinge pins in automobiles and other vehicles. More particularly, it relates to a hand tool that may be used by one person to remove hinge pins that are particularly difficult in the "unibody" construction of automobiles and other vehicles.

BACKGROUND OF THE INVENTION

In recent years there has been a trend to build automobiles with a single body construction in which the body of the vehicle performs as the frame for the rest of the components.

Previously, vehicles were built on a channel frame generally rectangular in shape and parallel to the ground or other rolling surface. In this prior construction, the wheels and axles were supported under the frame and the body and engine components were supported on top of the frame and fastened thereto. In such prior construction the various components could be detached from the frame in a repair or rebuilding process and once removed could be worked on separately.

However, in unibody construction the various components are a part of the body itself and therefore the components are difficult to remove. This is particularly true in connection with the hinges for the doors.

The hinges in automobile and vehicle doors usually comprise the stationary element fastened to the body, a rotary element fastened to the door, and a pin vertically oriented passing down through folded, vertically cylindrical trunion portions that are separately formed on the stationary portion and the rotary portion. In unibody construction the hinge components other than the hinge pin cannot be removed since they are welded into the body or into the door to become unitized with the particular member.

As a consequence of this construction, when it is necessary to remove the doors in repair or reconstruction operations the hinge pins must be removed from the hinges so that the doors can be removed.

Hinge pins generally come in two different basic forms. One form is the hollow pin pressure fitted within the vertical trunion portions as shown in U. S. Pat. No. 4,432,125 Monteleone et al. As shown in that patent, it is necessary to drive the hinge pin out of the trunions and this reference patent discloses a air hammer driven tool for this purpose.

On the other hand, hinge pins on many models of unibody built automobiles are of the solid cylindrical pin with an enlarged head of the type shown in U. S. Pat. No. 4,627,141 Teske (FIG. 7). This reference discloses a special air hammer driven tool to assist in the removal of "headed" pins of the second type.

This invention is directed to the removal of headed hinge pins with a one-hand manipulated tool. It has the purpose of removing headed hinge pins as further hereafter described. U. S. Pat. No. 4,188,701 Ludwig shows a hand-held tool which is constructed to assist in the removal of headed hinge pins of the type found in common building construction. The tool is constructed to be driven in under the head of the hinge pin while being held on an axis generally parallel to the hinge pin and in close proximity and juxtaposed thereto. When the tool is in position it is struck with a hammer first laterally to get it under the head of the hinge pin and then vertically to drive the hinge pin out of the hinge trunions.

There are several disadvantages in the use of this reference device which would make it unsuitable for use in removing hinge pins from unibody constructed automobile hinges.

In the first instance, it is necessary in the removal of steel body hinge pins to provide severe and heavy forces because the hinge pins are press-fitted and formed into the trunions. This is borne out by the prior two references Teske and Monteleone et al. which are operated by air hammers capable of providing severe impact.

In the second instance, the holding position is in close proximity to the position where the hammer blows must be struck. This, while perhaps efficient, when light, tapping blows are being applied, but not as a hand-held position in close proximity to the place where heavy blows are being struck because it means that the operator's hand is in danger of being struck by the heavy blows that are necessary to remove a hinge pin. Most mechanics feel insecure with their hand positioned so close to the place where heavy sledge hammer-like blows must be delivered. One misstruck blow and the operator's hand would be severely injured.

U. S. Pat. No. 3,602,969 Provost is another example of a similarly oriented hinge pin removing device for use in building construction and on building doors. It suffers from the same deficiencies as the previous patent when considered in the light of removing press-fitted hinge pins from vehicle doors.

SUMMARY OF THE DISCLOSURE

In summary, this invention is a hinge pin removal tool for use in removing a hinge pin from the hinge of a vehicle. The type of hinge to which this tool is especially applicable is that which has a shank portion with a head at one end.

The tool comprises: (a) a force delivering, driving portion including a lateral section having generally flat, opposite sides with a tined end having at one edge a tapered surface with a concave recess constructed to fit around the shank portion of the hinge pin and beneath the head portion of the hinge pin, with the driving portion being connected to an extension section at a generally obtuse angle, and with the extension section connected to a tab section in a generally right angle form; and (b) a handle portion fastened to the tab portion at a position in general prolongation of the extension section. A further feature of the tool is that it is constructed to receive heavy blows from a hammer at selected locations below and above the flat sides of the force delivering driving portion to effect removal of a hinge pin.

In further respects, the tool has means for engaging the shank of the hinge pin beneath the head of the hinge pin by a force delivering body means, with the body means including protrusions constructed to receive heavy blows from a heavy hammer operated by a tool operator, and includes a handle means connected to the driving means at a spaced distance from the hinge pin engaging means with the spaced distance being sufficient to prevent random, misguided blows from striking the hand of the operator on the handle.

The foregoing and other advantages of the invention will become apparent from the following disclosure in which the preferred embodiment of the invention is described in detail and illustrated in the accompanying drawings. It is contemplated that variations and procedure, structural features and arrangement of parts may appear to those skilled in the art without departing from the scope or sacrificing any of the advantages of the invention.

DETAILED DESCRIPTION OF A PREFERRED EMBODIMENT OF THE BEST MODE OF CARRYING OUT THE INVENTION

Figure 1:
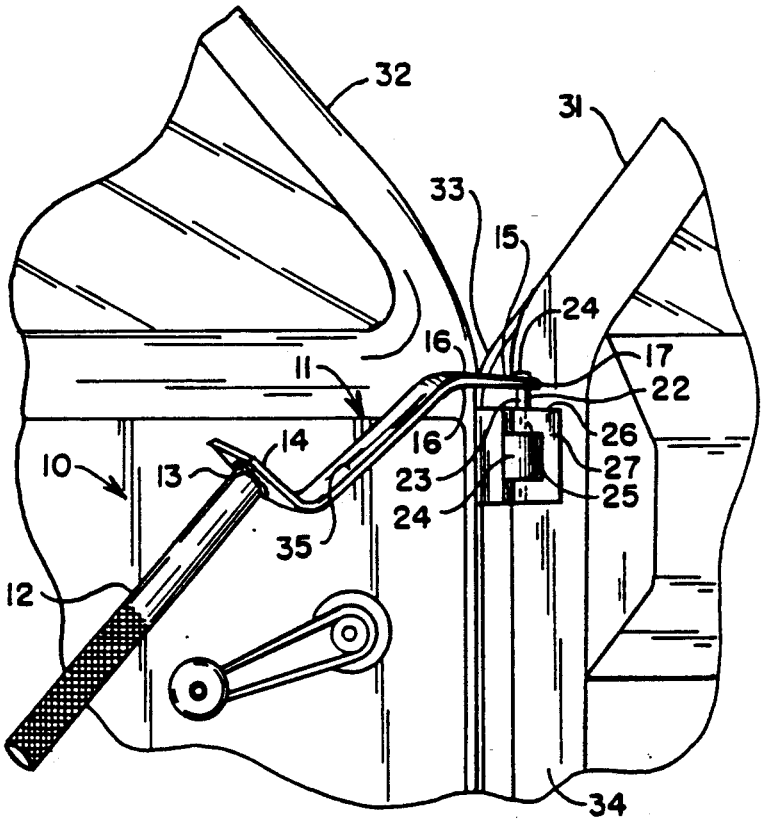
FIG. 1 is a perspective view of the hinge pin tool of this invention. In operating position at the side of a hinge in a portion of a unibody built vehicle panel.
Figure 2:
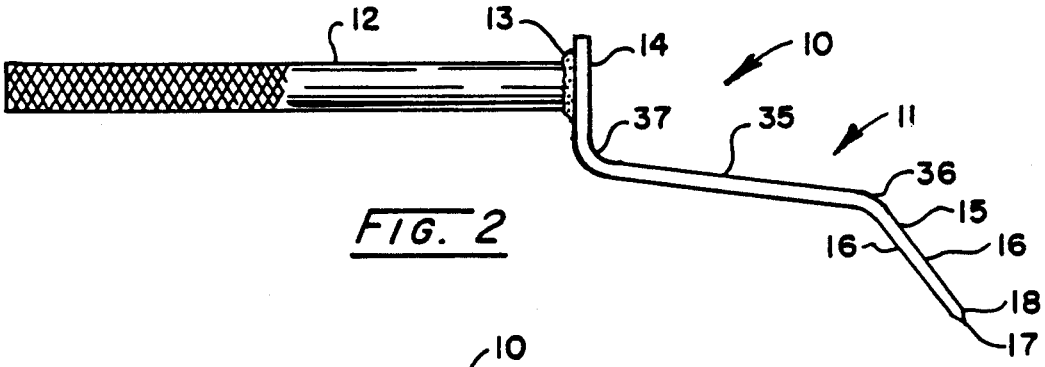
FIG. 2 is a side view of the hinge pin tool of this invention.
Figure 3:
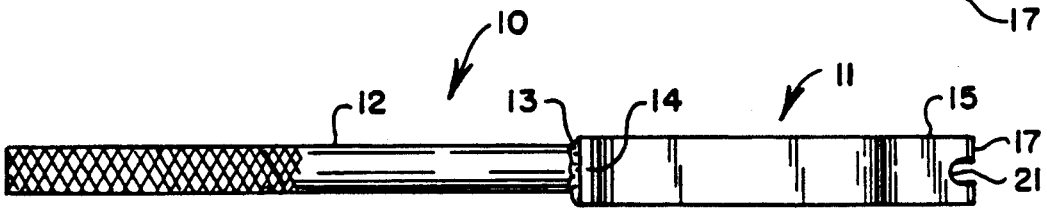
FIG. 3 is a top view of the hinge pin tool of this invention.

Referring to FIGS. 1, 2 and 3, a tool 10 includes a driving portion 11 and a handle portion 12 brought together and fastened, as by a weld 13. The driving portion 11 includes a tab section 14 to which the handle 12 is fastened.

At the opposite end from the tab section 14, and a spaced distance therefrom the driving portion 11 includes a lateral section 15, which is formed with generally flat, opposite sides 16. At one edge 17, the lateral section 15 is provided with a tapered surface 18 and a concave recess 21 which is constructed to fit around the shank portion 22 of a hinge pin 23.

The hinge pin 23 is provided with a head 24 which in normal operation prevents the hinge pin from passing downward beyond a trunion section 25 of a unibody hinge 26. The hinge 26 includes the body portion 27 and the door portion 28 which are formed into trunions through which the hinge pin passes. The hinge pin 22 provides the axis of rotation for the door relative to the body as in the normal construction of a hinge.

As shown in FIG. 1, a portion of a unibody automobile 31 meets a door 32 at the closure edge 33.

At the end opposite the edge 17, the lateral section is formed into an extension section 35 with an obtuse angle 36 ending in general prolongation of the handle 12. At the other end, the extension section 35 is formed into the tab section 14 at a substantially right angle 37. The obtuse angle 36 and the right angle 37 are of only general descriptive conformation since it is not important for these angles to be exact. It is sufficient, that the angles are such that the longitudinal axis of the handle 12 is at an obtuse angle to the lateral section 15, so that hammer blows delivered to the force delivery, driving portion are not in the direction of the longitudinal axis of the handle 12.

It has been found that in the business of repairing the bodies of wrecked automobiles, time is a very important element. With this in mind, this invention provides a "one-man" tool, since the tool is configured to provide the handle 12 for gripping with the one hand of the operator. The handle 12 may be knurled to provide a better gripping surface. The other hand of the operator is free to swing a heavy hammer and to provide heavy, forceful, driving blows to the driving portion 11 of the tool 10 at a spaced distance from a handle 12. The handle 12 is spaced at sufficient distance the driving portion 11 that any glancing or misstruck blows will not "ricochet" onto the hand which is holding the handle portion 12.

Providing a "one-man" tool means that operators can work alone to handle the tasks that are involved and particularly in removing hinge pins 22. It has been found, that when it is necessary for two operators to work in conjunction with each other much time is wasted in the coordination process since it is not necessary for one to wait for the availability of the other.

Because of the various angles provided in the driving portion 11, hammer blows can be provided from various directions and at appropriate places along the length of the driving portion to force the edge 17 and end 18 into the crevice between the hinge member 26 and the head 17 of the hinge pin 22. In addition, once the end 18 is in position beneath the head 17 and surrounding the shank 22 with the recess 21 blows may be delivered from below on the flat surface of the lateral section 15. In other instances, blows may be struck on the upper or lower surfaces of the extension section 35.

In addition to the advantages in the shape of the tool 10 in preventing misstruck blows from reaching the hand of the operator on the handle, there is another important advantage which is that the tool fits conveniently into place generally curving to the curvature of the door section which is the common shape found in unibody construction as shown in the curved edges 33 in FIG. 1.

It is herein understood that although the present invention has been specifically disclosed with the preferred embodiments and examples, modifications and variation of the concepts herein disclosed may be resorted to by those skilled in the art. Such modifications and variations are considered to be within the scope of the invention and the appended claims.

I claim:

1. A hinge pin removal tool for use in removing a hinge pin from the hinge of a vehicle, said hinge pin including a shank portion having a longitudinal axis and with a head at one end, comprising:

a) a force delivering, driving portion having generally flat opposite sides including a lateral section disposed generally lateral to said longitudinal axis of the hinge pin, said lateral section having a tined end having at one edge a tapered surface with a concave recess constructed to fit around the shank portion of the hinge pin and beneath the head portion of the hinge pin, said driving portion including a connection from the lateral section to an extension section having generally flat opposite sides in extension of the flat sides of the lateral section, at a generally obtuse angle, and with the extension section connected to a tab section at a substantially right angle, and a handle portion fastened to the tab section at a position in general prolongation of and spaced apart from the lateral section by the extension section;

said tool being constructed with said flat sides in said force delivering driving portion, to receive heavy blows, in the direction of the longitudinal axis of the shank portion of the hinge pin on either side of the lateral portion, and to receive heavy blows at an angle inclined from the lateral portion on either side of the extension section, from a hand-held hammer at selected locations below and above the flat sides of the force delivering driving portion, to effect removal of a hinge pin.

2. A hinge pin removal tool according to claim 1 wherein the handle portion is roughened to provide a non-slip gripping surface for a hand of the tool operator.

3. A tool according to claim 1 wherein the handle is cylindrical in shape and welded to the tab section of the driving portion.

* * * * *